US005577594A

United States Patent [19]

Belvederi

[11] Patent Number: 5,577,594

[45] Date of Patent: Nov. 26, 1996

[54] CIGARETTE MANUFACTURING UNIT

[75] Inventor: Bruno Belvederi, Pietro, Italy

[73] Assignee: G.D Societa' Per Azioni, Bologna, Italy

[21] Appl. No.: 336,267

[22] Filed: Nov. 8, 1994

[30] Foreign Application Priority Data

Nov. 9, 1993 [IT] Italy ..... B093A0452

[51] Int. Cl.[6] ..... B65G 1/00

[52] U.S. Cl. ..... 198/347.3; 198/358

[58] Field of Search ..... 198/347.1, 347.2, 198/347.3, 347.4, 358, 951, 405, 363, 606, 443, 456, 457

[56] References Cited

U.S. PATENT DOCUMENTS

| | | | |
|---|---|---|---|
| 3,341,036 | 9/1967 | Bardenhagen | 198/347.3 |
| 3,608,698 | 9/1971 | Crall | 198/358 X |
| 4,161,094 | 7/1979 | Blidung et al. | 198/358 X |
| 4,161,244 | 7/1979 | Hunter et al. | 198/347.4 |
| 4,684,118 | 8/1987 | Boss et al. | 198/347.3 X |
| 4,860,880 | 8/1989 | Hinchcliffe et al. | 198/951 X |
| 5,109,650 | 5/1992 | Hogenkamp | 198/347.4 X |
| 5,190,428 | 3/1993 | Bryant et al. | 198/358 X |

FOREIGN PATENT DOCUMENTS

| | | | |
|---|---|---|---|
| 1091019 | 12/1957 | Germany | 198/951 |
| 1303653 | 1/1973 | United Kingdom . | |
| 2084101 | 4/1982 | United Kingdom . | |

*Primary Examiner*—James R. Bidwell

*Attorney, Agent, or Firm*—Marshall, O'Toole, Gerstein, Murray & Borun

[57] ABSTRACT

A cigarette manufacturing unit at least partly defining a cigarette manufacturing and processing line, and wherein a first machine, located along the line, presents two outputs for substantially similar streams of cigarettes, and each connected to the input of a respective second machine by a bulk conveyor; the second machines being located along the manufacturing line and being independent of each other; and the conveyors being connected to each other by a compensating conveyor.

5 Claims, 2 Drawing Sheets

CIGARETTE MANUFACTURING UNIT

BACKGROUND OF THE INVENTION

The present invention relates to a cigarette manufacturing unit.

More specifically, the present invention relates to a manufacturing unit at least partly defining a cigarette manufacturing and processing line, and comprising a first machine with two outputs for substantially similar streams of cigarettes; two second machines with respective inputs; and two bulk cigarette conveyors, each connecting a respective output of the first machine to the input of a respective second machine.

The present invention may be applied to advantage to manufacturing units of the above type, and in particular of the type described and illustrated in Italian Patent Application n. BO92A 000311 wherein said first machine consists of a filter assembly machine supplied by a manufacturing machine with a stream of double cigarette portions. According to the above patent application, each double cigarette portion is cut in half into two coaxial single portions which are parted for inserting a double filter to which the single portions are joined by means of a connecting strip to form a double cigarette. The double cigarettes so formed are then cut in half to form two streams of single cigarettes, which are fed to respective outputs of the filter assembly machine. The cigarettes in the two streams are oppositely oriented, and may be oriented the same way by turning over the cigarettes in one of the streams either upstream from the respective output, as in the above patent, or in known manner downstream from the output.

According to the above patent application, the cigarettes at the two outputs are transferred to the inputs of respective independent packing machines by means of respective bulk conveyors.

In the above known manufacturing unit, though substantially similar, the two streams of cigarettes supplied to the packing machines may differ slightly, due to different numbers of cigarettes in each stream being rejected on the filter assembly machine; and, though normally set to the same output rate, the two packing machines may also reject different numbers of cigarettes, thus resulting in a different throughput on each machine.

When combined, both the above factors may result in one of the bulk conveyors being emptied and so arresting both its own and the other packing machine, due to both streams of cigarettes being linked, and nonthroughput on either one of the two bulk conveyors resulting in immediate stoppage of the filter assembly machine.

The same also applies in the event the above manufacturing unit is replaced by a similar unit for producing and processing plain cigarettes, and wherein the filter assembly machine is replaced, for example, by a dual-rod cigarette manufacturing machine.

SUMMARY OF TEE INVENTION

It is an object of the present invention to provide a manufacturing unit of the above type, designed to overcome the aforementioned drawbacks.

According to the present invention, there is provided a cigarette manufacturing unit at least partly defining a cigarette manufacturing and processing line, and comprising a first machine located along the line and presenting two outputs for substantially similar streams of cigarettes; two second machines located along the line and independent of each other; and two bulk cigarette conveyors, each connecting a respective said output to the input of a respective said second machine; characterized in that it also comprises compensating conveyor means located, and for transferring cigarettes, between said two conveyors.

According to a preferred embodiment of the above manufacturing unit, the compensating conveyor means comprise at least one reversible compensating conveyor interposed between and communicating with the two conveyors. Alternatively, the compensating conveyor means comprise two one-way compensating conveyors operating in opposite directions, and interposed between and communicating with the two conveyors.

The compensating conveyor means of the above manufacturing unit also preferably define at least one channel with two ends communicating respectively with the two conveyors and equioriented in relation to the longitudinal axis of the channel. Alternatively, the compensating conveyor means define at least one channel with two ends communicating respectively with the two conveyors and rotated 180° in relation to each other and in relation to the longitudinal axis of the channel.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
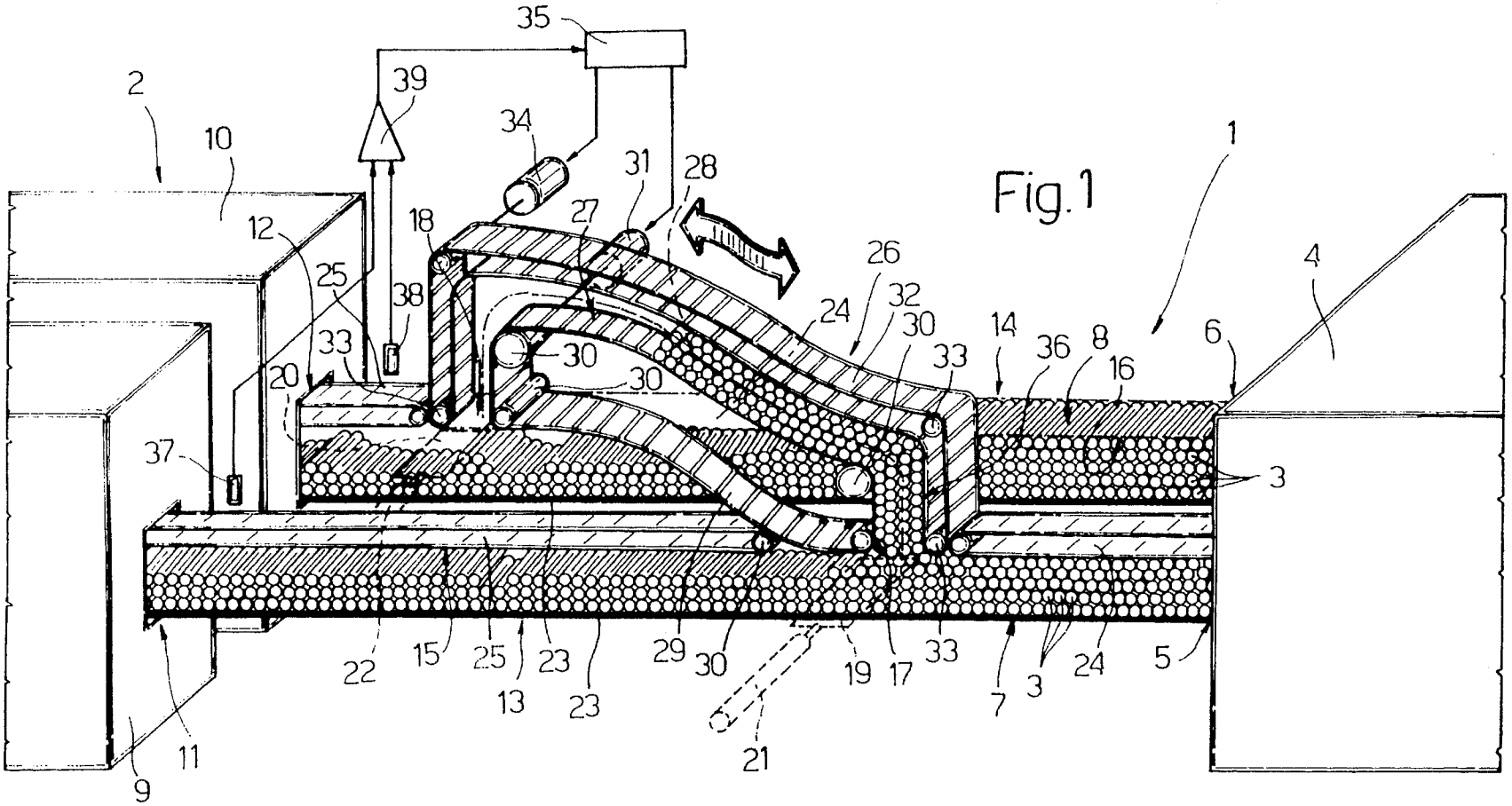
FIG. 1 shows a schematic view in perspective and partial block diagram of a preferred embodiment of the manufacturing unit according to the present invention.

Number 1 in FIG. 1 indicates a manufacturing unit at least partly defining a cigarette manufacturing and processing line 2, and comprising a first machine 4 located along line 2 and consisting of a filter assembly machine of the type described and claimed in Italian Patent Application n. BO92A000311. Machine 4 presents two outputs 5 and 6 for substantially similar streams 7 and 8 of equioriented cigarettes 3.

Unit 1 also comprises two second machines 9 and 10 located along line 2 and consisting of two known independent packing machines with respective inputs 11 and 12; and two known bulk cigarette conveyors 13 and 14 for respectively feeding streams 7 and 8 from respective outputs 5 and 6 to respective inputs 11 and 12.

Conveyors 13 and 14 define respective channels 15 and 16 extending between respective outputs 5 and 6 and respective inputs 11 and 12, and presenting respective lateral openings 17 and 18 closable in known manner by respective movable walls 19 and 20 operated by respective actuators 21 and 22.

In practice, openings 17 and 18 are preferably formed through the bottom walls of channels 15 and 16. For the sake of clarity, however, in the example shown, each channel 15, 16 is defined at the bottom by a continuous wall in turn defined by a respective continuous one-way conveyor belt 23; and is defined at the top by a wall interrupted by respective opening 17, 18 and defined by two one-way conveyors 24 and 25 arranged in series and operated, in known manner not shown, at the same speed as respective conveyor 23, for feeding respective stream 7, 8 of cigarettes 3 at said speed to respective input 11, 12.

Channels 15 and 16 are connected to each other by a compensating conveyor 26 defining a compensating channel 27 extending between openings 17 and 18 and communicating with channels 15 and 16 through openings 17 and 18 when movable walls 19 and 20 are set to the open position. In the example shown, compensating channel 27 presents a substantially U-shaped longitudinal axis 28, and is defined on the inside by a continuous wall in turn defined by a continuous conveyor belt 29 looped about pulleys 30, one of which is fitted to the output shaft of a reversible motor 31. On the outside, channel 27 is defined by a continuous conveyor belt 32 looped about pulleys 33—one of which is fitted to the output shaft of a motor 34—and guided in known manner by means of external guides (not shown) so as to travel along a U-shaped path.

Motors 31 and 34 are controlled in known manner by a control system 35, so as to operate respective conveyors 29 and 32 at the same speed and transfer a compensating stream 36 of cigarettes 3 between channels 15 and 16. Operation of motors 31 and 34 in one direction or the other is controlled by known sensors 37 and 38 which, in the example shown, emit in known manner signals proportional, for example, to the quantity of cigarettes inside channels 15 and 16. The signals emitted by sensors 37 and 38 are compared by a comparator 39 which so controls system 35 as to maintain streams 7 and 8 substantially equal to each other, and so prevent either one of channels 15 and 16 from being emptied and causing a total stoppage of unit 1.

Figure 2:
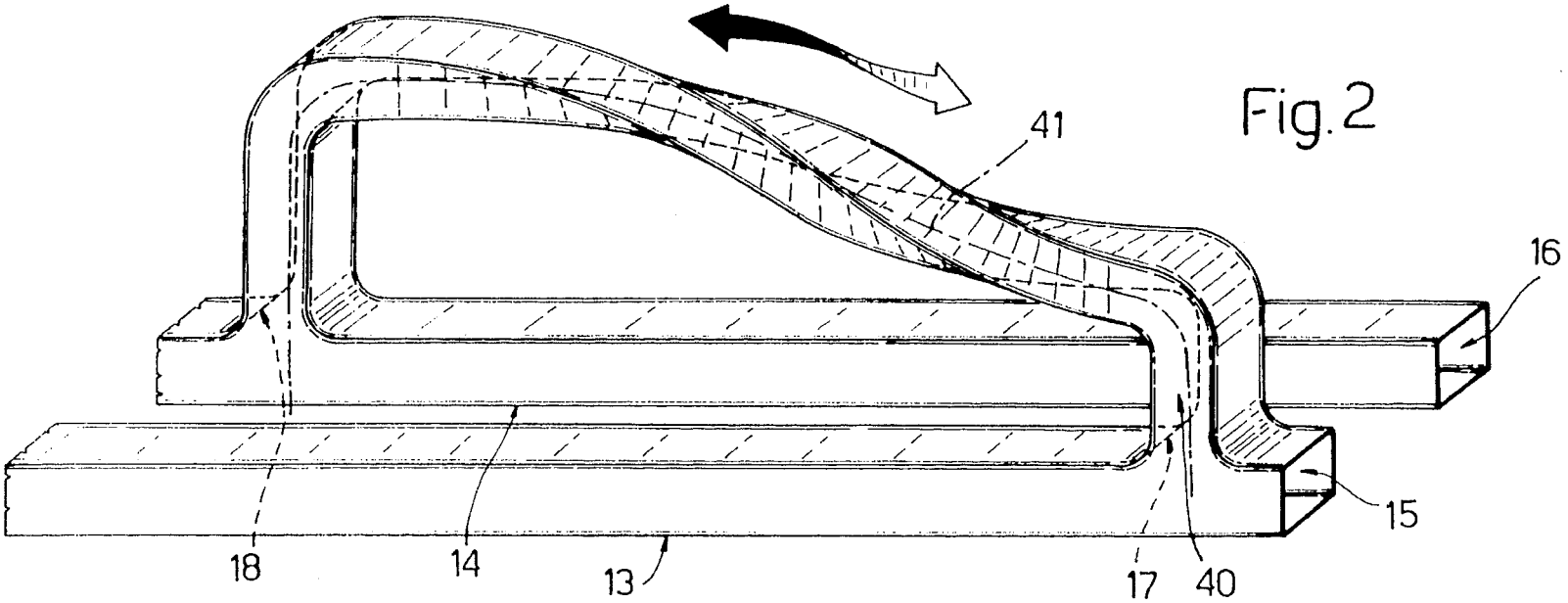
FIG. 2 shows a schematic view in perspective of a first variation of the FIG. 1 unit.

In the FIG. 1 embodiment, openings 17 and 18 are equioriented in relation to axis 28, whereas, in the FIG. 2 variation, channels 15 and 16 are connected by a compensating channel 40 twisted 180° between the two channels, so that openings 17 and 18 are rotated 180° in relation to each other and in relation to the longitudinal axis 41 of channel 40.

The above design of channel 40 provides for compensating two streams 7 and 8 of oppositely-oriented cigarettes 3, and is used to advantage in the case of a two-output filter assembly machine with no intern turnover device.

Figure 3:
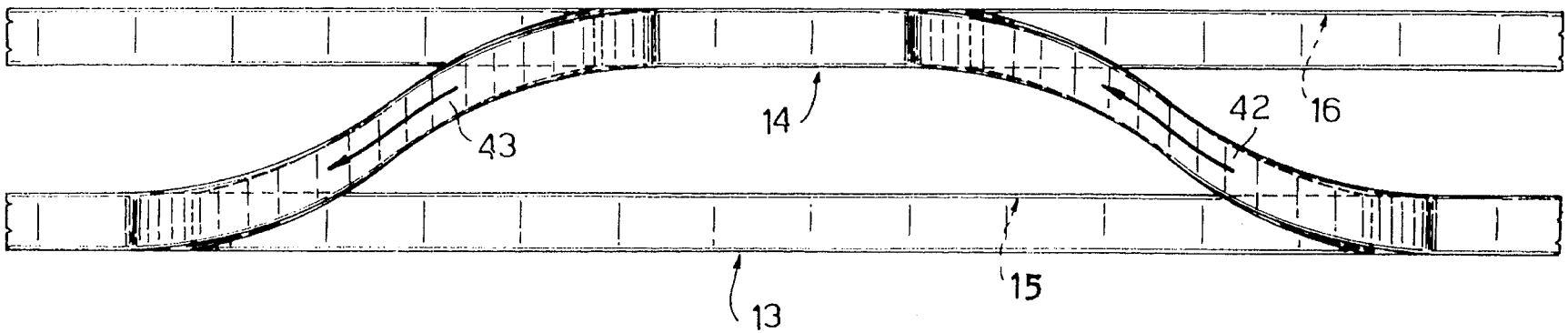
FIG. 3 shows a schematic view in perspective of a second variation of the FIG. 1 unit.

In the FIG. 3 variation, compensating channel 27 in FIG. 1 is replaced by two one-way channels 42 and 43 for feeding respective streams (not shown) of cigarettes 3, the first from channel 15 to channel 16, and the second from channel 16 to channel 15. In the event channels 15 and 16 are connected to the outputs of a filter assembly machine with no internal turnover device, channels 42 and 43 are obviously replaced by respective twist channels (not shown) similar to channel 40.

I claim:

1. A cigarette manufacturing unit at least partly defining a cigarette manufacturing and processing line, and comprising a first machine located along the line and presenting two outputs for substantially similar streams of cigarettes; two second machines located along the line and independent of each other; two bulk cigarette conveyors, each connecting a respective said output to the input of a respective said second machine; and compensating conveyor means for transferring cigarettes between said two conveyors; said compensating conveyor means including at least one compensating continuous conveyor, arranged at a fixed location in relation to said two conveyors, and defining a fixed U-shaped channel for cigarettes in bulk; said channel being interposed for cigarettes in bulk; said channel being interposed between and communicating with said two conveyors.

2. The unit as claimed in claim 1, wherein said compensating conveyor means includes a reversible compensating conveyor.

3. The unit as claimed in claim 1, wherein said compensating conveyor means comprise two one-way compensating conveyors operating in opposite directions; the two one-way compensating conveyors being interposed between and communicating with said two conveyors.

4. The unit as claimed in claim 1, wherein said channel has two ends communicating respectively with said two conveyors and equioriented in relation to the longitudinal axis of the channel.

5. The unit as claimed in claim 1, wherein said channel has two ends communicating respectively with said two conveyors and rotated 180° in relation to each other and in relation to the longitudinal axis of the compensating channel.

* * * * *